US007992301B2

(12) United States Patent
Lecoester et al.

(10) Patent No.: US 7,992,301 B2
(45) Date of Patent: Aug. 9, 2011

(54) METHOD FOR MANUFACTURING AN EXHAUST ELEMENT OF AN EXHAUST LINE OF A VEHICLE WITH A HEAT ENGINE AND EXHAUST ELEMENT, NAMELY OBTAINED THROUGH IMPLEMENTING SAID METHOD

(75) Inventors: François Pierre Paul Lecoester, Sochaux (FR); Murlidhar Kadandale, Belfort (FR); Paul A. Hyndman, Walbridge, OH (US)

(73) Assignee: Faurecia Systems d'Echappement, Societe par Action Simplifiee, Nanterre (FR)

( * ) Notice: Subject to any disclaimer, the term of this patent is extended or adjusted under 35 U.S.C. 154(b) by 885 days.

(21) Appl. No.: 11/970,007

(22) Filed: Jan. 7, 2008

(65) Prior Publication Data

US 2008/0163488 A1 Jul. 10, 2008

(30) Foreign Application Priority Data

Jan. 10, 2007 (FR) ..... 07 52607

(51) Int. Cl.
*B23P 17/00* (2006.01)
*B21D 51/16* (2006.01)

(52) U.S. Cl. ..... 29/890.08

(58) Field of Classification Search ..... 29/890.08
See application file for complete search history.

(56) References Cited

U.S. PATENT DOCUMENTS

| | | | | |
|---|---|---|---|---|
| 5,783,782 | A * | 7/1998 | Sterrett et al. | 181/272 |
| 6,158,547 | A * | 12/2000 | Ackermann et al. | 181/256 |
| 6,412,596 | B1 * | 7/2002 | Brandt et al. | 181/256 |
| 6,543,576 | B1 * | 4/2003 | Cofer et al. | 181/252 |
| 6,883,558 | B2 * | 4/2005 | Jander | 141/1 |
| 7,077,922 | B2 * | 7/2006 | Brandt et al. | 156/73.1 |
| 2008/0290547 | A1 * | 11/2008 | Kashikar et al. | 264/119 |
| 2008/0292739 | A1 * | 11/2008 | Kashikar et al. | 425/211 |

* cited by examiner

*Primary Examiner* — Derris H Banks
*Assistant Examiner* — Kaying Kue
(74) *Attorney, Agent, or Firm* — Egbert Law Offices PLLC

(57) ABSTRACT

The invention relates to a method for manufacturing an exhaust element of an exhaust line of a vehicle with a heat engine. The exhaust element includes a box having, internally, at least one compartment and at least one tube extending at least partly inside such a compartment. The method includes inserting sound-insulation into at least one such compartment. The insertion is ensured through injection into such a compartment through an opening in the tube from the inside of the tube. The invention also relates to an exhaust element obtained by implementing this method, including forming a box with at least one compartment containing sound-insulation and at least one tube extending at least partly inside at least one such compartment, the tube having an opening provided for in the body of the tube.

16 Claims, 3 Drawing Sheets

METHOD FOR MANUFACTURING AN EXHAUST ELEMENT OF AN EXHAUST LINE OF A VEHICLE WITH A HEAT ENGINE AND EXHAUST ELEMENT, NAMELY OBTAINED THROUGH IMPLEMENTING SAID METHOD

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a method for manufacturing an exhaust element of an exhaust line of a vehicle with a heat engine as well as an exhaust element obtained through implementing this method.

This invention relates to the field of the car industry, and more specifically to that of the material permitting to ensure the exhaust of gases resulting from the combustion of fuel within an internal combustion heat engine.

2. Description of Related Art Including Information Disclosed Under 37 CFR 1.97 and 37 CFR 1.98

Such an exhaust system is, at least partly, in the form of an exhaust line connected to the heat engine and including a plurality of exhaust elements following each other at the level of this exhaust line, this in the direction of the exhaust-gas flow.

In particular, this exhaust line includes at least one exhaust element formed by a sound-decontamination element usually adopting the form of a silencer or the like.

Such an exhaust element is in the form of a box, formed by assembling two half-shells or a rolling/crimping method. Inside the box, an inlet tube extends, being connected to the engine and, on the other hand, an outlet tube ends, directly or indirectly, into the atmosphere.

Such a box includes, internally, at least two compartments, on the one hand, a compartment into which end the inlet and outlet tubes and, on the other hand, at least one acoustic compartment containing sound-insulation means designed so as to ensure an absorption of the noises generated by the gas flow inside the exhaust line.

In this respect, it should be noted that there are several solutions for arranging, inside such a box, such sound-insulation means, usually formed of fibers or the like.

A first embodiment consists of enclosing such fibers in a bag, which is inserted by force into the box. Such an embodiment has disadvantages related to the risk of breaking of such a bag during its insertion into the box, to the insufficient quantity of fibers inserted into this box and to the improper distribution of these fibers in the box. Another disadvantage is that the box must have a geometry authorizing the insertion of such a bag. Moreover, upon insertion of such a bag into the box, it is absolutely necessary to close this box, which results into an additional step in the method for manufacturing the exhaust element.

These disadvantages have partially been coped with through a box formed by assembling two half-shells and which can have, internally, a particular geometry permitting to define, at least partially, said compartments, even the inlet and/or outlet tubes at the level of at least one such half-shell. The insulation means are also formed of fibers arranged in a bag, namely a polypropylene bag, positioned inside such a half-shell before ensuring the assembling of the two half-shells in order to close the box. This bag is designed, on the one hand, so as to retain the fibers during the assembling of the half-shells and, on the other hand, so as to degrade by the heat of the exhaust gases, in order to allow an adequate distribution of these fibers in the box. This embodiment has however disadvantages, which consist in that it is necessary to design a bag with the geometrical characteristics specific and particularly adapted to the geometry of the two half-shells. In addition, it is necessary to proceed with very particular care to the installation of such a bag inside such a half-shell and during the closing of the box, this in order to avoid any degradation of this bag. Finally, the manufacture of such an exhaust element implies the implementation of a method including a significant number of steps.

BRIEF SUMMARY OF THE INVENTION

The present invention intends to be capable of coping with the disadvantages of the devices and the methods of the state of the art.

To this end, the invention relates to a method for manufacturing an exhaust element of a exhaust line of a vehicle with a heat engine, the exhaust element including a box having, internally, at least one compartment and at least one tube extending at least partly inside such a compartment. This method consists of inserting sound-insulation means into at least one such compartment of the exhaust element, wherein the insertion of the sound-insulation means is ensured by injecting these insulation means into such a compartment, this through an opening provided for in the body of the tube and through the inside of the latter.

Another feature consists in that the injection is ensured through an injection means, in particular a nozzle or the like, extending inside the tube and ending in front of or through the opening of this tube.

An additional feature relates to the fact that the tube provided with the opening is positioned, in particular through inserting it into the box (in particular by sliding), inside the case so that this opening is located inside a compartment, this before proceeding to injecting the insulation means into this compartment.

According to another feature, the opening provided for in the tube is located inside the injection compartment at least throughout the injection.

According to a first embodiment, insulation means are injected into at least one compartment through the opening of the tube, this before ensuring the closing of this opening by closing means.

According to a second embodiment, insulation means are injected into at least one compartment through the opening of the tube, this before moving the tube so that its opening is closed by a component of the exhaust element or is located outside the compartment into which the insulation means have been injected.

An additional feature consists of the tube provided with the opening being immobilized inside the box after injection of the insulation means, even after closing of the opening or, as the case may be, positioning of this opening outside the injection compartment.

According to another feature, sound-insulation means formed of one single fiber are continuously injected into one compartment.

According to a first embodiment, sound-insulation means are injected into one compartment, respectively a single compartment. A box of a silencer, respectively of a silencing device, forming the exhaust element, includes this sound-insulation means through an opening provided for in the tube, before ensuring the closing of this opening.

However and according to a second embodiment, sound-insulation means are injected into one compartment. A box of a silencer includes, before ensuring the displacement of the tube inside the box so that its opening is located in another compartment, this box, comprising, namely with a view to injecting, sound-insulation means into this other compartment.

A particular embodiment consists in that the box comprises three aligned compartments. The tube is so positioned that its opening is located in the intermediate compartment before injecting insulation means into this intermediate compartment.

Yet another feature consists in that, when insulation means are injected into an acoustic compartment of a box having several compartments, the tube is so positioned that, on the one hand, its opening is located in the acoustic compartment inside which the insulation means are injected and, on the other hand, it ends outside this acoustic compartment, namely into a compartment that does not contain any insulation means.

The invention also relates to an exhaust element for an exhaust line of a vehicle with a heat engine, namely achieved by implementing the method according to any of the preceding claims, and which includes a box having internally at least one compartment. At least one acoustic compartment contains sound-insulation means. At least one tube extends at least partly inside at least one such acoustic compartment, wherein the element has an opening provided for in the body of the tube and which is either closed by closing means or by a component of the exhaust element, or located in one compartment, namely other than an acoustic compartment containing of the sound-insulation means.

In fact, such an exhaust element can be formed by a silencing device, a silencer or the like.

The advantages of the method according to the present invention reside in that insulation means are injected into an acoustic compartment, this through the inside of this compartment and through an opening provided for in a tube extending inside the exhaust element and maintained inside the latter after the injection.

By carrying out such an injection, a homogeneous and adequate distribution of the insulating material is ensured inside a compartment, this irrespective of the geometry and the configuration of such a compartment.

Such an injection also permits to insert the appropriate quantity of insulating material into a box in order to ensure an optimal filling of same, while avoiding the areas without insulating material.

Another advantage of the invention resides in that the insertion of insulation means into a compartment is particularly easy. In particular and in the case of a box including a plurality of aligned compartments, it is particularly easy to insert insulation means into an intermediate compartment such an alignment includes, in contrast to the methods of the state of the art.

According to another advantage, the method can consist, in the case of a plurality of compartments, in inserting insulation means only into part, even in all, of these compartments.

Moreover, the positioning of the opening of the tube and its mouth with respect to two compartments advantageously permits to avoid the insertion of insulation means into a compartment other than the one into which such insulation means are injected, this at least temporarily and during this injection.

In addition and in the case of a plurality of acoustic compartments, the method permits to inject various products and/or products according to different doses into each of these acoustic compartments.

Another advantage resides in that the installation of the means for injecting the insulation means occurs simultaneously with the installation of the tube inside which this injection means is positioned, which advantageously allows reducing the number of steps in the method for manufacturing an exhaust element.

In addition, the injection of insulation means occurs while the box of such an exhaust element is closed, so that this injection is ensured in a closed compartment, advantageously preventing any leakage and any loss of insulating material.

Yet another advantage resides in that the injection of insulation means, even the displacement of the tube, can be ensured in a fully automated way, which permits to optimize the method for manufacturing said exhaust element.

According to another advantage, the insulation means inserted into a compartment are formed of one single fiber, in particular a continuously injected fiber. Such insulation means advantageously permits to avoid the disadvantages of insulation means in the form of short or cut fibers, in particular so-called carcinogenic fibers.

Finally, the method according to the invention advantageously permits using some existing components of an exhaust element, the tools and some steps of the manufacturing methods of the state of the art, this in order to improve the manufacture of such an exhaust element.

In particular, this method permits to use the presence of a tube as well as its positioning necessarily inside a box, in order to insert insulation means into this box through this tube.

Other aims and advantages of the present invention will become clear during the following description referring to embodiments that are given only by way of indicative and non-restrictive examples.

This description will be better understood when referring to the attached drawings.

DETAILED DESCRIPTION OF THE INVENTION

The present invention relates to the field of the car industry, and more specifically to that of the material permitting to ensure the exhaust of gases resulting from the combustion of a fuel within an internal combustion heat engine.

Such an exhaust system is usually in the form of an exhaust line connected to the engine, including, in the direction of the exhaust-gas flow, a succession of exhaust elements 1.

Figure 1:
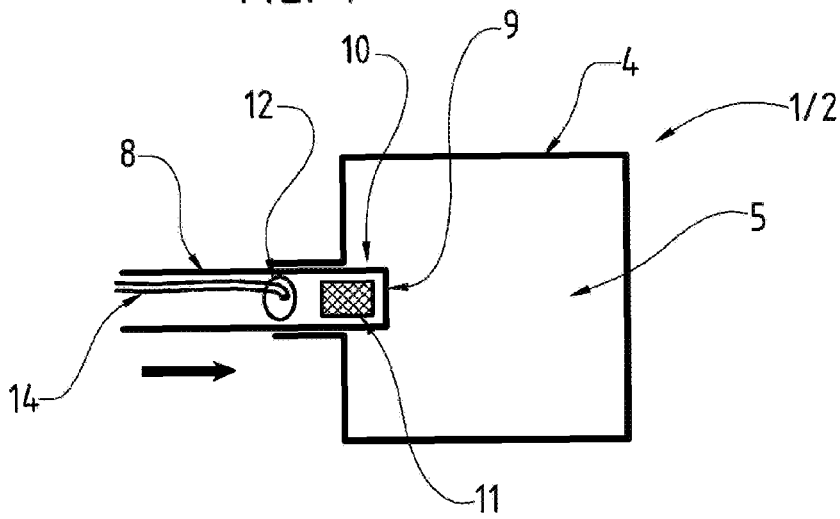
FIGS. 1, 1*a*, and 1*b* are schematic longitudinal cross-sectional views corresponding to an exhaust element according to a first embodiment of the invention and to various steps of a method for manufacturing such an exhaust element and according to the invention.
Figure 1A:
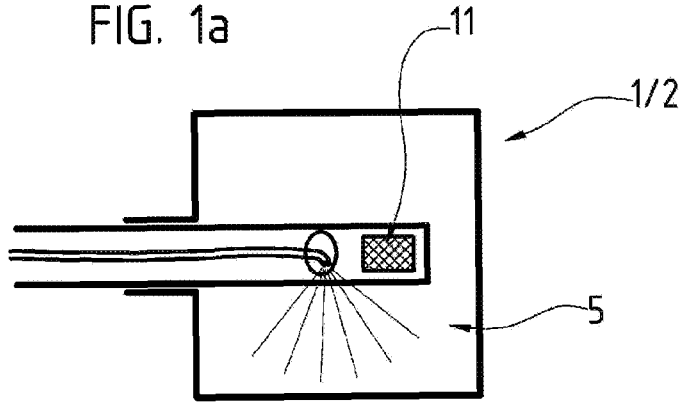
Figure 1B:
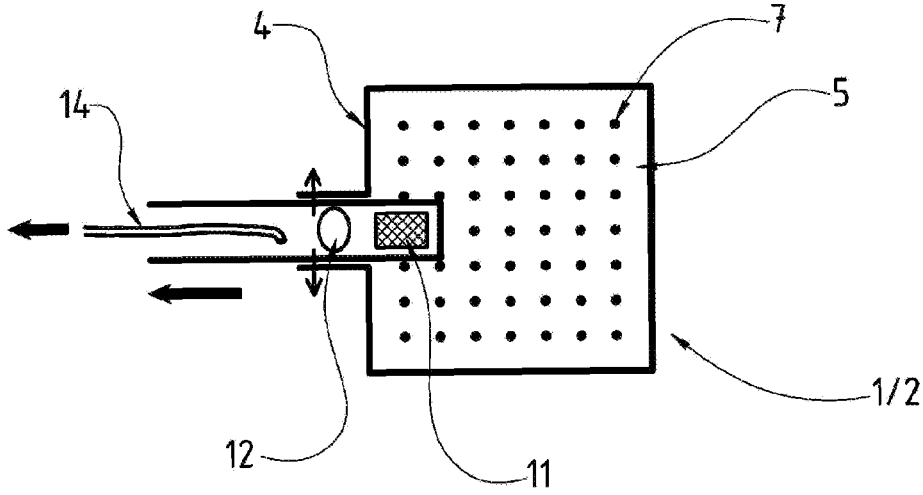

In particular, such an exhaust line includes at least one exhaust element 1 formed of a sound-decontamination element which, according to a first embodiment shown in FIGS. 1 to 1*b*, can adopt the form of a silencing device 2 connected, in particular in parallel, to an exhaust conduit of the exhaust line. However, such a sound-decontamination element can also adopt the form of a silencer 3 according to a second embodiment shown in FIGS. 2 to 2*b* and, respectively, a third embodiment in FIGS. 3 to 3*c*.

Though reference will be made, in the continuation of the description, more specifically to an exhaust element 1 adopting the form of such a sound-decontamination element, the present invention is however not at all limited thereto.

In fact and as can be seen in the attached figures, such an exhaust element 1 includes a box 4 having, internally, at least one compartment 5.

More specifically and as can be seen in FIGS. 1 to 1*b*, an exhaust element 1 in the form of a silencing device 2 can include one single compartment 3.

Figure 2:
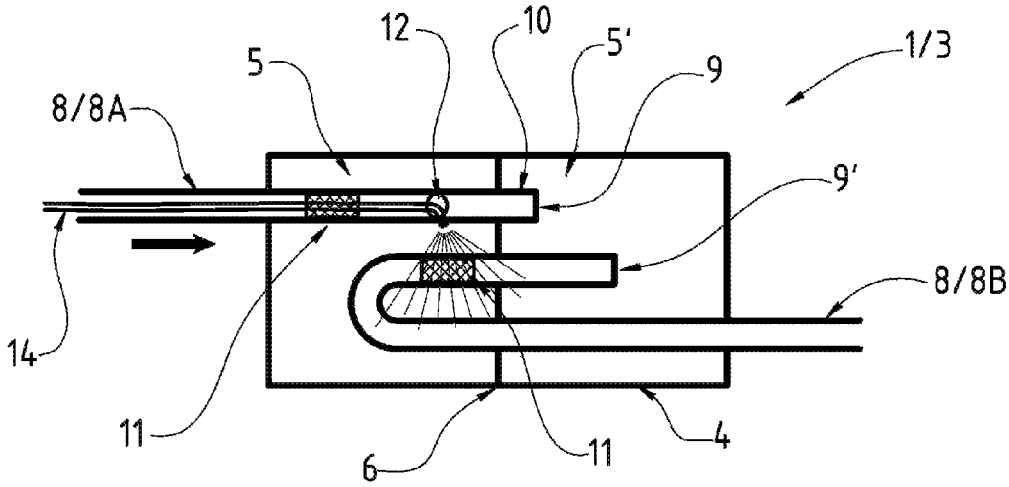
FIGS. 2, 2*a*, 2*b* are schematic and sectional views similar to the preceding figures, corresponding to various steps of a method according to the invention, the method for manufacturing an exhaust element according to a second embodiment.
Figure 2A:
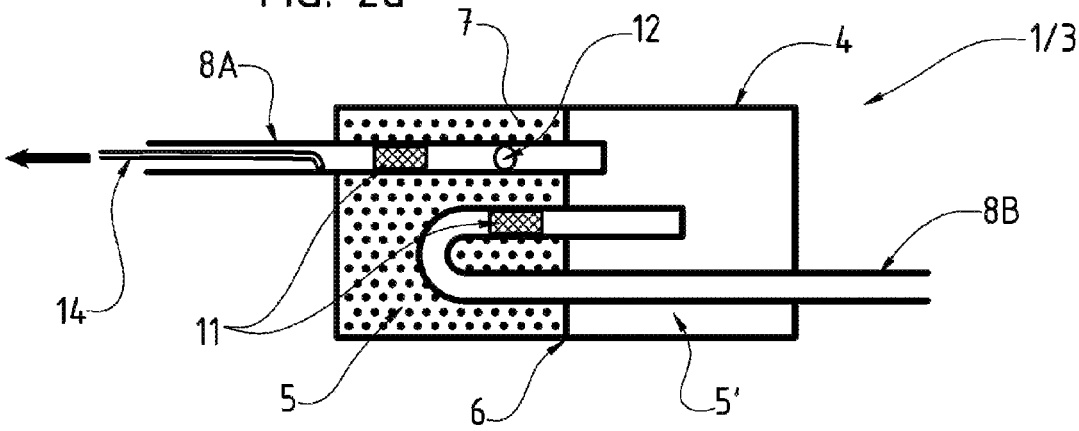
Figure 2B:
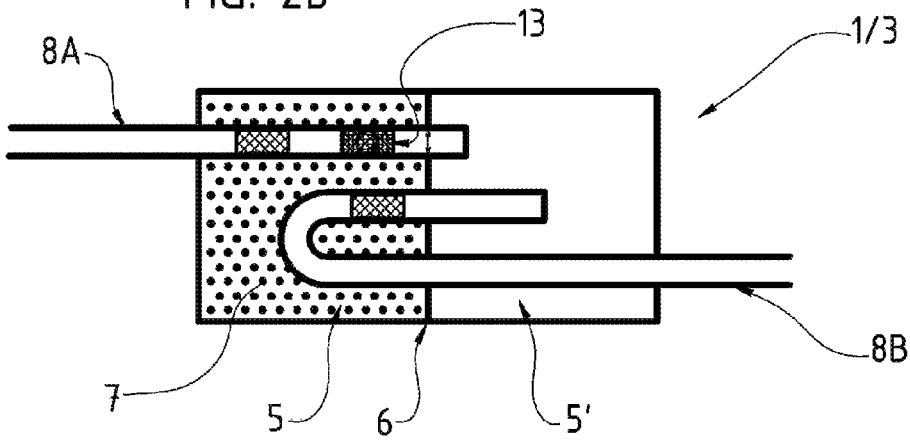
Figure 3:
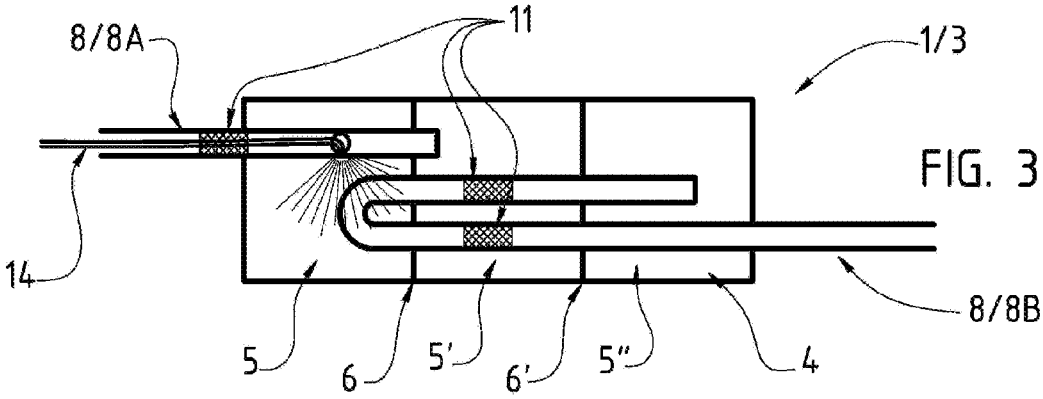
FIGS. 3, 3*a*, 3*b*, 3*c* are schematic and sectional views similar to the preceding figures and corresponding various steps of a method for manufacturing an exhaust element, the method according to a third embodiment.

However and as can be seen in FIGS. 2 to 2*b*, an exhaust element 1 in the form of a silencer 3 can include a plurality of compartments 5, 5', 5" as well as at least one cap 6. FIGS. 3 to 3*c* show another cap 6' permitting to delimit, in a gas-tight way, two compartments 5, 5' or 5', 5" of these compartments 5, 5', 5".

It should be noted that at least one of these compartments 5, 5', 5" forms an acoustic compartment containing sound-isolation means 7 designed so as to decrease the sound disturbances resulting from the flow of the exhaust gases in the exhaust line.

In this respect and in the case of an exhaust element 1 formed of a silencer 3 having a plurality of compartments 5, 5', 5", such sound-insulation means 7 can be contained in one single compartment 5 (FIGS. 2*a*, 2*b*), in a plurality of these compartments 5, 5' (FIGS. 3*b*, 3*c*), even in all the compartments 5, 5', 5" of the box 4 of such an exhaust element 1 (solution not shown).

A particular embodiment of an exhaust element 1, formed of a silencer 3 having a box 4 with at least three aligned compartments 5, 5', 5", consists of at least the intermediate compartment 5' containing such sound-insulation means 7. In such a case, at least part of the compartments 5, 5" contiguous to this intermediate compartment 5' may (compartment 5, FIGS. 3*b*, 3*c*)—or may not (compartment 5", FIGS. 3*b*, 3*c*)—contain sound-insulation means 7.

In fact, such insulation means 7 are made out of a material having a good resistance, on the one hand, to heat, such as that of the exhaust gases proceeding from the engine, and, on the other hand, to erosion, such as that caused by the vibration of the exhaust line and/or by the shock waves resulting from the flow of exhaust gases in this exhaust line.

In this respect and according to a preferred embodiment, such sound-insulation means 7 are formed of fibers, more specifically of ceramic fibers and/or glass fibers or the like.

It should be noted that, according to the invention, the insulation means 7 contained in a compartment 5,5', 5" are formed of one single fiber, which advantageously permits coping with the disadvantages of the insulation means of the state of the art and formed of short or cut fibers, so-called carcinogenic fibers.

A particular embodiment of an exhaust element 1 according to the invention and including a plurality of compartments 5, 5', 5", consists of an insulation means 7, contained in two different compartments 5, 5', 5". The different compartments have a different nature and/or a different composition, in particular in terms of components and/or dosages (FIGS. 3*b* and 3*c*).

Another feature of the invention consists in that the exhaust element 1 also includes at least one tube 8 that penetrates into the box 4 and extends at least partly inside at least one compartment 5, 5', 5" of the box 4 of this exhaust element 1.

As can be seen in the attached figures, such a tube 8 ends inside a compartment 5, 5', 5" of the box 4 of the exhaust element 1. This tube 8 includes a mouth 9 at the level of one of its ends 10, which is then located inside such a compartment 5, 5', 5".

Another feature of such a tube 8 consists in that the tube 8 has, at the level of at least a portion of this tube 8 located in a compartment 5, 5', 5" (more specifically in an acoustic compartment 5, 5'), perforations 11 authorizing the passing of the exhaust gases through tube 8, as the case may be, from the inside of this tube 8 towards said compartment 5, 5', 5", or vice-versa.

According to the invention, such a tube 8 has at least one opening 12 provided for in the body of this tube 8. The opening 12 permits insertion of the insulation means 7 therethrough and from the inside towards the outside of this tube 8, the insulation means 7 being inserted into an acoustic compartment 5, during manufacture of the exhaust element 1.

According to a first embodiment and after the manufacture of such an exhaust element 1, such an opening 12 is preferably closed.

In this respect, it should be noted that such a closing can be ensured by a component of the exhaust element 1.

As can be seen in FIG. 1*b*, such a component can be formed by the wall of the box 4 of the exhaust element 1 or by a bearing for receiving the tube 8. A cap 6, 6' defining two compartments 5, 5' or 5', 5" (not shown) is also included. In such a case, said opening 12 is located outside a compartment 5 (namely an acoustic compartment) of the box 4.

Another embodiment shown in FIG. 2*b* consists in that such a closing can be ensured by specific closing means 13, namely formed of a sleeve (more specifically of an expansible type), by a ring (more specifically of a retractable type) or the like. Such closing means 13 is, more specifically, adapted to an opening 12 located inside a compartment 5, 5', 5", more specifically a compartment 5 of an acoustic type (FIG. 2*b*).

According to a second embodiment and after manufacture of such an exhaust element 1, such an opening 12 is of an emerging type and is located inside a compartment 5, 5', 5" of the box 4. In this respect and as can be seen in FIGS. 3*b* and 3*c*, such an opening 12 then ends preferably into a compartment 5" other than an acoustic compartment (5, 5'), i.e. containing no insulation means 7.

Another feature consists in that such a tube 8 is immobilized inside the box 4, more specifically with respect to a wall of this box 4 and/or with respect to at least one cap 6, 6'. In this connection, one will observe that such an immobilization can be performed, as the case may be, through welding, insertion by force, expansion or crimping of the tube 8, as will be described hereinafter.

As evoked above, said exhaust element 1 can be formed of a sound-decontamination element defined by a silencing device 2 or the like.

Such a silencing device 2 then includes one single tube 8 connected to the engine, more specifically while being connected, in particular in parallel, to a conduit of the exhaust line. This tube 8 extends at least partly inside the single compartment 5 of the box 4, whereby it ends into the latter 5 with its mouth 9 and/or perforations 11, whereas its opening 12 is closed by the wall of this box 4 (FIG. 1*b*).

However, said exhaust element 1 can also be formed by a silencer 3 including two tubes 8A, 8B. The inlet tube 8A is connected to the engine, extending at least partly inside the box 4, more specifically through at least one compartment 5, 5' (more specifically formed by at least one acoustic compartment), and ending, with its mouth 9, in another compartment 5', 5" (FIGS. 2*a*, 2*b*; 3*b*, 3*c*). It should be noted that this other compartment 5', 5" can be of an acoustic type, but is preferably a compartment 5', 5" other than an acoustic compartment (FIGS. 2*a*, 2*b*; 3*b*, 3*c*).

Furthermore, such a silencer 3 includes an outlet tube 8B ending outside this silencer 3 (in particular in the atmosphere), extending inside said box 4, and ending, with its mouth 9', in the compartment 5', 5" of the box 4 in which 5', 5" also ends the inlet tube 8A (FIGS. 2*a*, 2*b*; 3*b*, 3*c*).

It should be noted that these inlet 8A and outlet 8B tubes pass through the cap or caps 6, 6', separating these compartments 5, 5', 5", preferably in tight manner, this in order to avoid any diffusion of the insulation means 7 outside their compartment.

In fact, such an inlet tube 8A and/or such an outlet tube 8B can have an opening 12 of the above-mentioned type. However and according to a preferred embodiment of the invention, it is more specifically the inlet tube 8A of such a silencer 3 that includes such an opening 12, as can be seen in the attached FIGS. 2 to 2*b* and 3 to 3*c*.

The invention also relates to a method for manufacturing an exhaust element 1 an exhaust line of a vehicle with a heat engine includes.

As evoked above, such an exhaust element 1 includes, on the one hand, a box 4 having, internally, at least one compartment 5, 5', 5" and, on the other hand, at least one tube 8 extending at least partly inside such a compartment 5, 5', 5".

One of the steps of this method then consists of inserting sound-insulation means 7 into at least one such compartment 5, 5', 5", this for forming at least one compartment of the acoustic type containing such insulation means 7.

According to the invention, the insertion of these insulation means 7 into a compartment 5, 5', 5" is ensured through injecting these insulation means 7 into such a compartment, this through the opening 12 provided for in the body of tube 8 and through the inside of the latter 8.

In fact, such an injection is ensured through injection means 14 extending inside the tube 8 and ending in front of or through the opening 12 in such a tube 8.

As can be seen in the attached figures, such injection means 14 can adopt the form of an injection nozzle or the like including, on the one hand, a tubular body extending axially with respect to the tube 8 and inside the latter 8 and, on the other hand, a nozzle, extending this tubular body, oriented in the direction of the opening 12, and having a curvature chosen for an appropriate flow of the insulation means 7.

In fact, this nozzle has preferably a curvature the radius of which varies between 40 and 60 mm, and is preferably of about 50 mm.

According to a preferred embodiment of the invention, this injection means 14 is, at least partly, made out of a material having an adequate resistance to abrasion caused by a flow of insulation means 7, more specifically formed of fibers, namely of ceramics or glass fibers. In fact, this injection means 14 is made out of stainless steel, more specifically (but not exclusively) at the level of its nozzle.

In this respect, it should be noted that the method consists, in fact, of injecting into a compartment 5, 5', 5", preferably in a continuous way, sound-insulation means 7 formed of one single fiber.

According to another feature of the invention, before proceeding to the injection of the insulation means 7 into a compartment 5, the tube 8 provided with the opening 12 is positioned inside the box 4, this so that this opening 12 is located inside a compartment 5, 5', 5" into which the insulation means 7 must be injected.

In this respect, it should be noted that, according to a first embodiment, not shown and corresponding more specifically to a silencing device 2, the tube 8, provided with such an opening 12, can be made integral with a wall of the box 4, respectively with a half-shell such a box 4 includes, before surrounding this tube and this wall with a casing in order to form such a box 4, respectively before closing the box 4 by means of a second half-shell.

According to this same embodiment and in the case of a silencer 3, the inlet 8A and outlet 8B tubes can be made integral with at least one cap 6, 6', before positioning the aggregate (tubes 8A, 8B and caps 6, 6') in a box 4 (in particular in the form of an assembly of two half-shells) or surrounding this assembly with a casing (in particular of the rolled-crimped type) in order to form such a box 4.

However and according to a preferred embodiment of the invention shown in the attached figures, the tube 8 provided with the opening 12 is positioned inside the box 4 through inserting (in particular sliding) this tube 8 into an at least partly closed box 4, this so that said opening 12 of the tube is located inside a compartment 5, 5', 5" into which the insulation means 7 must be injected.

In a preferred way, the tube 8 provided with the opening 12 and the injection means 14 are simultaneous inserted into the box 4.

To this end, the method preferably consists of maintaining said injection means 14 inside the tube 8 during their insertion into the box 4, this in a position in which said injection means 14 ends in front of or through the opening 12 provided for in the body of this tube 8.

As evoked above, before performing the injection of the insulation means 7 into a compartment 5, 5', the tube 8 provided with the opening 12 is positioned inside the box 4. This opening 12 is located inside a compartment 5, 5' into which the insulation means 7 must be injected. In this respect, it should be noted that, in the case of a box 4 including a plurality of compartments 5, 5', 5", the tube 8 is so positioned that its opening 12 is located in the injection compartment 5, 5', while the mouth 9 of this tube 8 is preferably located outside this injection compartment 5, 5' (FIGS. 2, 3, 3*a*), namely in a compartment 5', 5" into which the insulation means 7 may be injected—or not—later on.

According to another feature of the invention, the method consists in that the opening 12 provided for in the tube 8 is located inside the injection compartment 5, 5', 5", at least throughout the injection of the insulation means 7 into such a compartment 5, 5', 5".

Therefore and according to a first embodiment, the tube 8 is positioned in the box 4 so that its opening 12 is thus located (FIG. 2), then, one proceeds to injecting the insulation means 7 in this very position of the tube 8 and, after injecting these insulation means 7, this tube 8 is maintained in this position (FIG. 2*a*).

In such a case, the method consists, after injecting the insulation means 7, in ensuring the closing of this opening 12 through closing means 13 of the above-mentioned type (FIG. 2*b*).

However and according to a second embodiment, the method consists in that the insulation means 7 are injected into at least one compartment 5, 5', 5" through the opening 12 of tube 8, this before ensuring the displacement of tube 8.

According to a first embodiment, such a displacement is ensured so that the opening 12 of this tube 8 is closed by a component of the exhaust element 1, namely by a wall of the box 4 (FIG. 1*a*) or by the bearing of a cap 6, 6' of the box 4 of this exhaust element 1 includes internally.

Figure 3A:
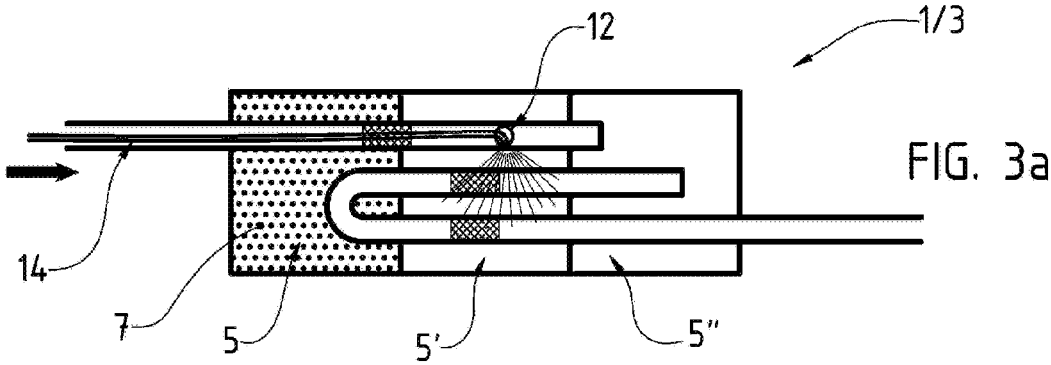
Figure 3B:
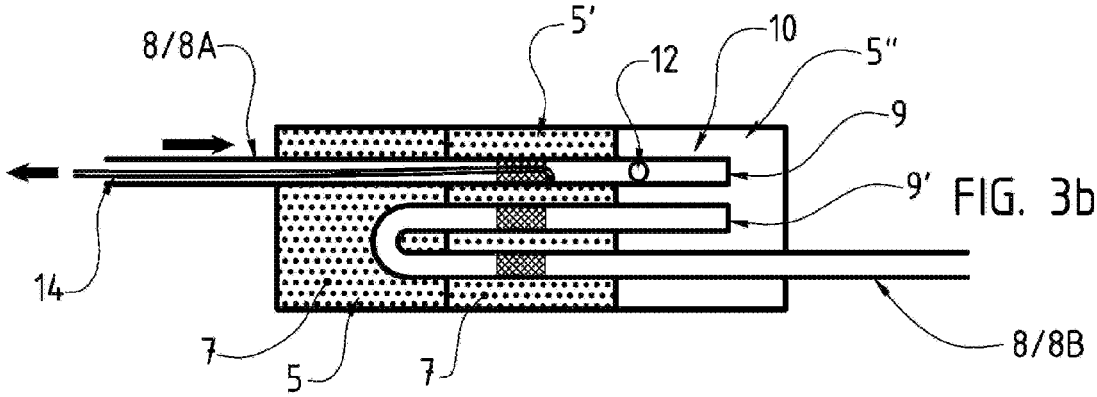
Figure 3C:
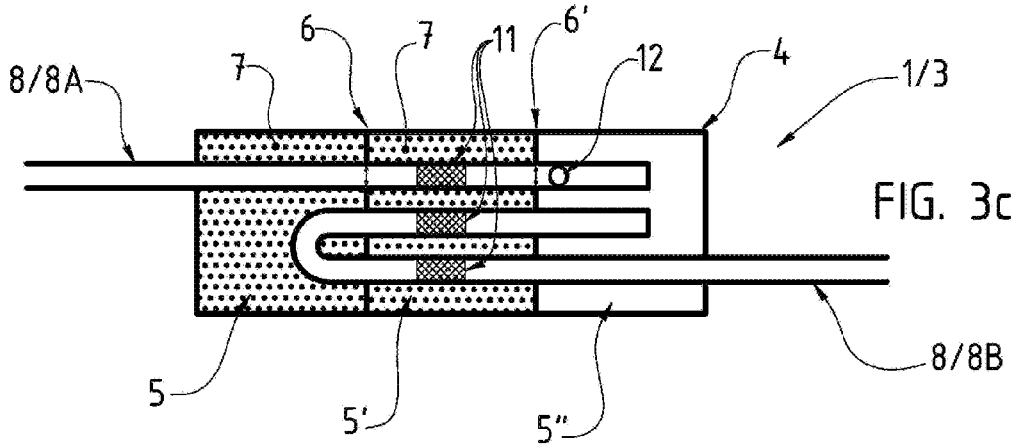

However and according to a second embodiment, namely shown in FIGS. 3*a*, 3*b* and 3*c*, such a displacement is ensured so that the opening 12 of this tube 8 is located outside the compartment 5; 5' into which the insulation means 7 were injected.

This opening 12 is then located in another compartment 5', 5" into which the insulation means 7 may be injected (FIGS. 3*a* and 3*b*)—or not (FIG. 3*c*).

It should be noted that the method according to the invention can consist of ensuring a plurality of displacements of the tube 8 in the box 4 and that, after the last displacement of this tube 8 in the box 4, the opening 12 of the latter 8 can, if necessary, be closed by closing means 13, namely of the above-mentioned type.

An additional feature of the method according to the invention consists in that the injection means 14 is removed from the tube 8 (FIGS. 1*b*, 2*a* and 3*b*) after injecting the insulation means 7 into the last (namely the only) acoustic compartment 5, 5', 5", or even after closing of the opening 12 or displacement of the tube 8 with a view to positioning this opening 12 outside the acoustic compartment or compartments 5, 5', 5".

According to another feature of the invention, the method consists in ensuring the immobilization of the tube 8 provided with the opening 12 inside the box 4.

In this respect, it should be noted that such an immobilization can be ensured before injecting the insulation means 7, such as described above within the framework of an embodiment in which the tube 8 is made integral with at least one component of the box 4 (wall, cap 6, 6'), this before positioning the aggregate (tubes and wall or caps) in a box 4 or surrounding this assembly with a casing.

However and according to a preferred embodiment, the tube 8 provided with the opening 12 is immobilized inside the box 4 after injecting the insulation means 7 into at least one acoustic compartment 5, 5', 5" (FIG. 1*b*), even into all the acoustic compartments 5, 5', 5" when the exhaust element 1 includes a plurality of them (FIGS. 2*b* and 3*c*).

In fact and according to the first embodiment described above, such an immobilization is ensured before or, preferably, after closing the opening 12 of the tube 8, as the case may be, with a component of the box 4 (FIG. 1*b*) or with specific closing means 13 (FIG. 2*b*).

However and according to the second embodiment described above, such an immobilization is ensured after having ensured the positioning of the opening 12 of the tube 8 outside the acoustic compartment or compartments 5, 5' containing the insulation means 7 (FIG. 3*c*).

In this respect, it should be noted that the method consists in ensuring the immobilization of the tube 8, either with respect to a wall of the box 4 (FIG. 1*b*), or with respect to at least one cap (6; 6') included in the box 4 internally, subdividing this box 4 and defining two compartments 5, 5'; 5', 5" (FIGS. 2*b*; 3*c*).

In fact and according to a first embodiment, such an immobilization can be ensured through welding. However and according to a preferred embodiment of the invention, this immobilization is ensured through crimping or through expansion of the tube using a tool, namely including a mandrel.

In the continuation of the description will be described variants of the manufacturing method according to the invention, this within the framework of the manufacture of various exhaust elements 1.

Thus, in FIGS. 1 to 1*b* are shown various steps of a method for manufacturing an exhaust element 1 in the form of a silencing device 2. This method consists of inserting, by sliding, a tube 8 as well as the injection means 14 into a box 4 (FIG. 1) and locating the opening 12, the tube 8 including the opening 12 inside a compartment 5 into which the sound-insulation means 7 are then injected (FIG. 1*a*). After injecting these insulation means 7, the injection means 14 are removed and the tube 8 is moved so as to ensure the closing of its opening 12 by a component of the exhaust element 1, more specifically by a wall of its box 4 (FIG. 1*b*), this before immobilizing this tube 8 with respect to the box 4.

In FIGS. 2 to 2*b* are shown various steps of a method for manufacturing an exhaust element 1 in the form of a silencer 3 including two compartments 5, 5'.

This method consists of inserting a tube 8 into the box 4 of such an exhaust element 1 so that its opening 12 is located in an acoustic compartment 5 aimed at receiving sound-insulation means 7 and so that its mouth 9 ends outside this compartment 5, before injecting the sound-insulation means 7 into this compartment 5 (FIG. 2). This method consists, afterwards, in removing the injection means 14 (FIG. 2*a*) and ensuring the closing of the opening 12 of the tube 8 and the immobilization of this tube 8, namely through expanding this tube 8 for a co-operation with a cap 6 (FIG. 2*b*).

Within the framework of such an exhaust element 1, the method can also consist of injecting sound-insulation means 7 into one compartment of the box 4, a silencer 3 being included in the box 4, before ensuring the displacement of the tube 8 inside the box 4, so that its opening 12 is located in another compartment included in the box 4, namely with a view to the injection of sound-insulation means 7 into this other compartment (solution not shown).

Such a procedure is also applicable to an exhaust element 1 in the form of a silencer 3 including three aligned compartments 5, 5', 5", among which one intermediate compartment 5' and two compartments 5, 5" contiguous, on both sides, to this intermediate compartment 5' shown in FIGS. 3 to 3*c*.

However and as regards such an exhaust element 1, the method preferably consists in that the tube 8 is so positioned that its opening 12 is located in the intermediate compartment 5' before injecting sound-insulation means 7 into this intermediate compartment 5'.

The process can, in addition, consist of the sound-insulation means 7 being injected into at least another compartment 5, 5" different from the intermediate compartment 5', this after positioning the tube 8 so that its opening 12 is located in such another compartment 5, 5".

In this respect and as can be seen in FIGS. 3 to 3*c*, the method preferably consists of positioning the tube 8 so that its opening 12 (and the injection means 14) is located in a first compartment 5 (contiguous to the intermediate compartment 5') and injecting sound-insulation means 7 into the same (FIG. 3), before ensuring the displacement of the tube 8 (and the injection means 14) so that its opening 12 is located in the intermediate compartment 5', and before injecting sound-insulation means 7 into same (FIG. 3*a*). The method then consists of moving the tube 8 so that its opening 12 is located in another compartment 5", contiguous to the intermediate compartment 5', and into which sound-insulation means 7 may be injected—or not (FIG. 3*c*).

As can be seen in FIG. 3*c*, the tube 8, formed of an inlet tube 8A, is moved so that its opening 12 and its mouth 9 are finally located in a compartment 5" contiguous to the intermediate compartment 5', and in which the outlet tube 8B ends with its mouth 9'.

This method then consists in immobilizing the tube 8 inside the box 4 (FIG. 3*c*).

According to another feature regarding an exhaust element 1, the box 4 has several compartments 5, 5', 5" (FIGS. 2 to 2*b*; 3 to 3*c*). When insulation means 7 are injected into an acoustic compartment (5; 5, 5') of such a box 4, the tube 8 is positioned so that its opening 12 is located in the acoustic compartment inside which the insulation means 7 are injected, and the tube 8 ends with its mouth 9 outside this acoustic compartment, namely in a compartment containing no insulation means 7.

We claim:

1. A method of manufacturing an exhaust element of an exhaust line of a vehicle in which the exhaust line extends from an engine, the method comprising:

forming a box having at least one compartment in an interior thereof;

extending a nozzle through an interior of a tube, the tube having an opening through a wall thereof, said nozzle having an outlet adjacent said opening;

positioning said tube and said nozzle simultaneously into said box and at least partially within the compartment such that said opening of said tube and said outlet of said nozzle open to the compartment;

injecting a sound-insulation material through said nozzle and outwardly of said outlet and said opening of said tube into the compartment;

removing said nozzle from said tube after the step of injecting; and closing a communication of said opening with the compartment after the step of injecting.

2. The method of claim 1, the step of positioning occurring before the step of injecting.

3. The method of claim 1, the step of positioning comprising sliding said tube into said box.

4. The method of claim 1, said opening positioned in the compartment at least for an entire time of the step of injecting.

5. The method of claim 1, the step of closing comprising closing said opening of said tube.

6. The method of claim 1, the step of closing comprising:

moving said tube such that said opening is located outside of the compartment.

7. The method of claim 1, further comprising:

immobilizing said tube with respect to said box after the step of positioning.

8. The method of claim 7, further comprising:

forming a cap internally within said box such that said cap defines a pair of compartments with respect to a wall of said box, the step of immobilizing comprising fixing a position of said tube by said cap.

9. The method of claim 8, the step of immobilizing comprising:

inserting a mandrel into said tube; and welding said tube to a surface within said box.

10. The method of claim 8, the step of immobilizing comprising:

inserting a mandrel into said tube; and crimping said tube to a surface within said box.

11. The method of claim 8, the step of immobilizing comprising:

inserting a mandrel into said tube; and expanding said tube to a surface within said box.

12. The method of claim 1, said sound-insulation material being of a single fiber.

13. The method of claim 1, the step of forming comprising forming the box having a first compartment and a second compartment, the step of injecting comprising:

injecting the sound-insulation material into said first compartment;

moving said tube and said nozzle such that said opening opens to said second compartment; and injecting the sound-insulation material into said second compartment.

14. The method of claim 1, the step of forming comprising forming the box having a first compartment and a second compartment and a third compartment, the step of positioning comprising positioning said opening into said second compartment.

15. The method of claim 14, further comprising:

injecting said sound-insulation material into said second compartment; and moving said tube such that said opening faces another compartment other than said second compartment.

16. The method of claim 15, one of said first compartment and said second compartment and said third compartment containing no sound-insulation material.

* * * * *